US011247872B2

(12) United States Patent
Tracey et al.

(10) Patent No.: US 11,247,872 B2
(45) **Date of Patent: *Feb. 15, 2022**

(54) ELEVATOR CAR DOOR INTERLOCK

(71) Applicant: Otis Elevator Company, Farmington, CT (US)

(72) Inventors: Michael J. Tracey, Cromwell, CT (US); Richard E. Kulak, Niantic, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 267 days.

This patent is subject to a terminal disclaimer.

(21) Appl. No.: 16/163,003

(22) Filed: Oct. 17, 2018

(65) Prior Publication Data

US 2020/0122978 A1 Apr. 23, 2020

(51) Int. Cl.
*B66B 13/20* (2006.01)
*B66B 13/12* (2006.01)

(52) U.S. Cl.
CPC ..... *B66B 13/20* (2013.01); *B66B 13/12* (2013.01)

(58) Field of Classification Search
CPC ..... B66B 13/20; B66B 13/12; B66B 13/18
See application file for complete search history.

(56) References Cited

U.S. PATENT DOCUMENTS 3,913,270 A 10/1975 Kumagai
4,926,974 A 5/1990 Morris et al.
4,926,975 A 5/1990 Morris
4,947,964 A * 8/1990 Husmann ..... B66B 13/12 187/319
5,636,715 A 6/1997 Hayashi et al.
5,651,428 A 7/1997 Ahigian et al.
5,819,877 A 10/1998 Rivera et al.
6,220,396 B1 4/2001 Heath, III
6,446,759 B1 9/2002 Kulak et al.
7,252,179 B2 8/2007 Oberleitner
(Continued)

FOREIGN PATENT DOCUMENTS

CN 102041044 A 5/2011
CN 201864431 U 6/2011
(Continued)

OTHER PUBLICATIONS

European Search Report for Application No. 19203934.5; dated Jul. 13, 2020; 7 Pages.

(Continued)

*Primary Examiner* — Michael R Mansen
*Assistant Examiner* — Michelle M Lantrip
(74) *Attorney, Agent, or Firm* — Cantor Colburn LLP

(57) ABSTRACT

An elevator car door interlock includes a first link assembly having a first intermediate link movably connected to a first vane, and a first link having a first link first end pivotally connected to the first intermediate link and a first link second end pivotally connected to the second vane. A latch assembly includes a door latch pivotally connected to the baseplate wherein responsive to operation of a drive mechanism that is drivably connected to the first link second end, while an interlock roller engages at least one of the first vane and the second vane, the first vane moves towards the second vane and the door latch pivots to unlock an elevator car door.

11 Claims, 5 Drawing Sheets

(56) References Cited

U.S. PATENT DOCUMENTS

| | | | | |
|---|---|---|---|---|
| 7,350,623 | B2 | 4/2008 | Kinoshita et al. | |
| 7,370,731 | B2 * | 5/2008 | Cocher | B66B 13/20 187/330 |
| 7,398,862 | B2 | 7/2008 | Dziwak | |
| 7,464,794 | B2 | 12/2008 | Badaoui et al. | |
| 8,960,372 | B2 | 2/2015 | Heath et al. | |
| 9,656,835 | B2 | 5/2017 | Kitazawa | |
| 9,688,515 | B2 | 6/2017 | Macareno et al. | |
| 2005/0139429 | A1 * | 6/2005 | Bisang | B66B 13/12 187/319 |
| 2005/0145442 | A1 | 7/2005 | Cocher | |
| 2006/0107785 | A1 | 5/2006 | Zappa | |
| 2006/0225966 | A1 | 10/2006 | Cocher | |
| 2007/0295564 | A1 * | 12/2007 | Someya | B66B 13/20 187/319 |
| 2011/0186386 | A1 | 8/2011 | Gilli | |
| 2012/0298453 | A1 | 11/2012 | Fujii et al. | |
| 2017/0217732 | A1 | 8/2017 | Kitazawa | |
| 2018/0186606 | A1 | 7/2018 | Rhouzlane et al. | |
| 2020/0055705 | A1 | 2/2020 | Tracey et al. | |

FOREIGN PATENT DOCUMENTS

| | | | | | |
|---|---|---|---|---|---|
| CN | 202897753 | U | | 4/2013 | |
| CN | 102398833 | B | | 11/2013 | |
| CN | 102642758 | B | | 12/2013 | |
| CN | 103562116 | A | | 2/2014 | |
| CN | 204224051 | U | | 3/2015 | |
| CN | 204281004 | U | | 4/2015 | |
| CN | 204549769 | U | | 8/2015 | |
| CN | 204938677 | U | | 1/2016 | |
| CN | 204958087 | U | | 1/2016 | |
| CN | 105565126 | A | * | 5/2016 | |
| CN | 205222393 | U | | 5/2016 | |
| CN | 104555673 | B | | 8/2016 | |
| CN | 105967029 | A | * | 9/2016 | B66B 13/12 |
| CN | 205973392 | U | | 2/2017 | |
| CN | 106687405 | A | | 5/2017 | |
| CN | 106744199 | A | | 5/2017 | |
| CN | 107010519 | A | | 8/2017 | |
| CN | 105731229 | B | | 9/2017 | |
| CN | 206562251 | U | | 10/2017 | |
| CN | 107381305 | A | | 11/2017 | |
| CN | 207226777 | U | | 4/2018 | |
| CN | 107973200 | A | | 5/2018 | |
| CN | 207404666 | U | | 5/2018 | |
| EP | 0164581 | A1 | | 12/1985 | |
| EP | 2168902 | A1 | * | 3/2010 | B66B 13/12 |
| EP | 2157040 | B1 | | 1/2015 | |
| GB | 962422 | A | | 7/1964 | |
| JP | S4920420 | B1 | | 5/1974 | |
| WO | 03089356 | A1 | | 10/2003 | |
| WO | 2008149456 | A1 | | 8/2010 | |
| WO | 2017023927 | A1 | | 2/2017 | |
| WO | WO-2017031829 | A1 | * | 3/2017 | B66B 13/12 |

OTHER PUBLICATIONS

Chinese Office Action for Application No. 201910982789.8; dated Sep. 3, 2021; 9 Pages.

Chinese Office Action for 201910764016.2; dated Jun. 28, 2021; 7 Pages.

European Search Report for Application No. 19192683.1; dated Jul. 24, 2020; 8 Pages.

U.S. Non-Final Office Action for U.S. Appl. No. 16/105,360; dated Dec. 3, 2020; 20 Pages.

U.S. Non-Final Office Action for U.S. Appl. No. 16/105,360; dated Jun. 18, 2021; 26 Pages.

* cited by examiner

ELEVATOR CAR DOOR INTERLOCK

BACKGROUND

The embodiments herein relate to elevator car door interlocks.

Elevators or lift installations are arranged to move between landings of a multi-floor building. Elevators or lift installations are provided with sliding doors that are disposed on elevator car that are to remain closed during movement of the elevator between landings. Elevator codes require that the elevator car doors be provided with devices that inhibit the opening of the elevator car doors between landings and to facilitate opening of the elevator car doors at the landings. The elevator codes may also require a maximum gap between the elevator car doors when a force is applied.

SUMMARY

Disclosed is an elevator car door interlock that includes a first vane, a second vane, a first link assembly, and a latch assembly. The first link assembly includes a first intermediate link movably connected to the first vane, and a first link pivotally connected to a baseplate. The first link has a first link first end pivotally connected to the first intermediate link and a first link second end pivotally connected to the second vane. The latch assembly includes a door latch and a latch link. The door latch is pivotally connected to the baseplate and has a door latch first end and a door latch second end. The latch link has a latch link first end pivotally connected to the first intermediate link and a latch link second end pivotally connected to the door latch first end.

In addition to one or more of the features described herein, or as an alternative, further embodiments, the first vane defines a slot having a first slot first end and first slot second end.

In addition to one or more of the features described herein, or as an alternative, the first intermediate link includes a pivot pin that extends into the first slot and a second pivot that extends into the first vane.

In addition to one or more of the features described herein, or as an alternative, responsive to operation of a drive mechanism that is drivably connected to the first link second end, while an interlock roller is spaced apart from at least one of the first vane and the second vane, the first vane moves, relative to the baseplate, towards the second vane and the pivot pin is disposed proximate the first slot first end.

In addition to one or more of the features described herein, or as an alternative, while the pivot pin is disposed proximate the first slot first end, the first intermediate link is inhibited from pivoting about the second pivot and the door latch is inhibited from being pivoted.

In addition to one or more of the features described herein, or as an alternative, responsive to operation of a drive mechanism that is drivably connected to the first link second end, while an interlock roller engages at least one of the first vane and the second vane, the first vane moves, relative to the baseplate, towards the second vane and the pivot pin moves from the first slot first end towards the first slot second end.

In addition to one or more of the features described herein, or as an alternative, responsive to the pivot pin moving from the first slot first end towards the first slot second end, the first intermediate link pivots about the second pivot such that the latch link pivots the door latch.

Also disclosed is an elevator car door interlock that includes a first link assembly, a latch assembly, and a pawl. The first link assembly includes a first intermediate link movably connected to a first vane, and a first link pivotally connected to a baseplate, the first link having a first link first end pivotally connected to the first intermediate link and a first link second end pivotally connected to a second vane. The latch assembly includes a door latch pivotally connected to the baseplate that has a door latch first end and a door latch second end that is arranged to selectively engage a lock member to selectively inhibit opening of an elevator car door. The latch assembly also includes a latch link having a latch link first end pivotally connected to the first intermediate link and a latch link second end pivotally connected to the door latch first end. The pawl has a first pawl pivot connected to the baseplate and a second pawl pivot connected to at least one of the second vane and the first link second end.

In addition to one or more of the features described herein, or as an alternative, the first vane defines a first slot having a first slot first end and first slot second end.

In addition to one or more of the features described herein, or as an alternative, the first intermediate link includes a pivot pin that extends into the first slot, a second pivot that extends into the first vane, and a third pivot that extends into the latch link first end.

In addition to one or more of the features described herein, or as an alternative, the first link first end is disposed between the pivot pin and the second pivot.

In addition to one or more of the features described herein, or as an alternative, the first vane defines a first slot having a first slot first end and first slot second end, the first slot arranged to receive the pivot pin.

In addition to one or more of the features described herein, or as an alternative, further embodiments include a second link assembly spaced apart from the first link assembly. The second link assembly includes a second intermediate link movably connected to the first vane, and a second link pivotally connected to the baseplate. The second link has a second link first end pivotally connected to the second intermediate link and a second link second end pivotally connected to the second vane.

In addition to one or more of the features described herein, or as an alternative, the second vane defines a second slot having a second slot first end and second slot second end.

In addition to one or more of the features described herein, or as an alternative, the second intermediate link includes a pivot pin that extends into the second slot and a fifth pivot that extends into the first vane.

In addition to one or more of the features described herein, or as an alternative, responsive to operation of a drive mechanism that is drivably connected to the first link second end and the pawl in a first direction, while an interlock roller engages at least one of the first vane and the second vane, the first vane moves, relative to the baseplate, towards the second vane, at least one of the pivot pin moves from the first slot first end towards the first slot second end and the pivot pin moves from the second slot first end towards the second slot second end, such that the first intermediate link pivots about the second pivot such that the latch link pivots the door latch to disengage the lock member.

In addition to one or more of the features described herein, or as an alternative, responsive to operation of the drive mechanism in the first direction, the pawl pivots about first pawl pivot towards a lock position to maintain a first position between the first vane relative to the second vane.

In addition to one or more of the features described herein, or as an alternative, responsive to operation of the drive mechanism in a second direction that is opposite the first direction, the pawl pivots about the first pawl pivot towards an unlock position and the first vane is enabled to move, relative to the baseplate, away from the second vane.

In addition to one or more of the features described herein, or as an alternative, further embodiments include a biasing member connected to the first vane and at least one of the second vane and a second link second end.

In addition to one or more of the features described herein, or as an alternative, the biasing member is arranged to move the second vane such that the second intermediate link pivots about the fifth pivot and the first intermediate link pivots about the second pivot such that the latch link pivots the door latch to disengage the lock member.

Technical effects of embodiments of the present disclosure include, responsive to operation of a drive mechanism that is drivably connected to a first link second end and a pawl in a first direction, while an interlock roller engages at least one of the first vane and the second vane, the first vane moves, relative to the baseplate, towards the second vane, at least one of the pivot pin moves from the first slot first end towards the first slot second end and the pivot pin moves from the second slot first end towards the second slot second end, such that the first intermediate link pivots about the second pivot such that the latch link pivots the door latch to disengage the lock member.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
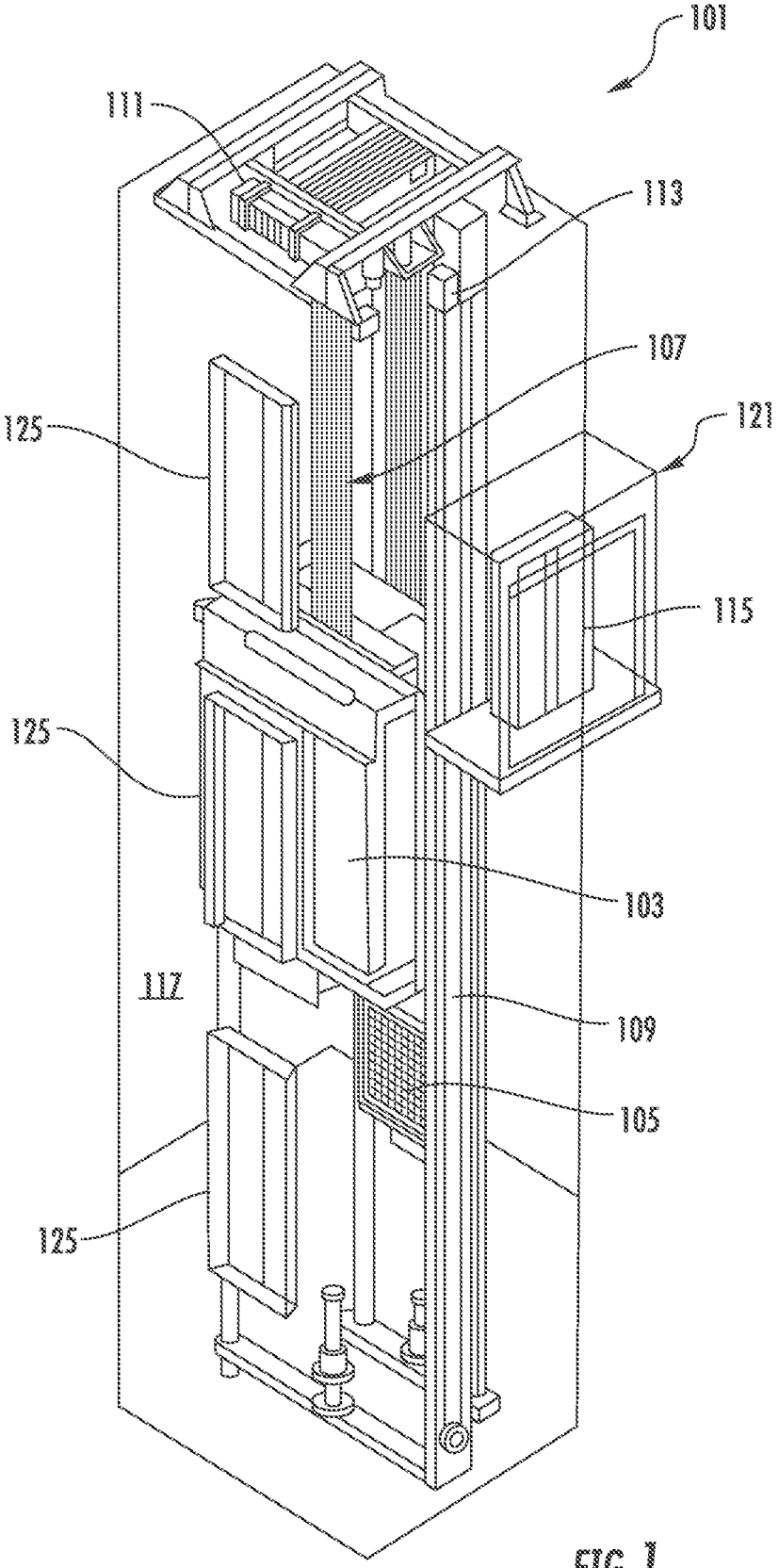
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller 115 may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
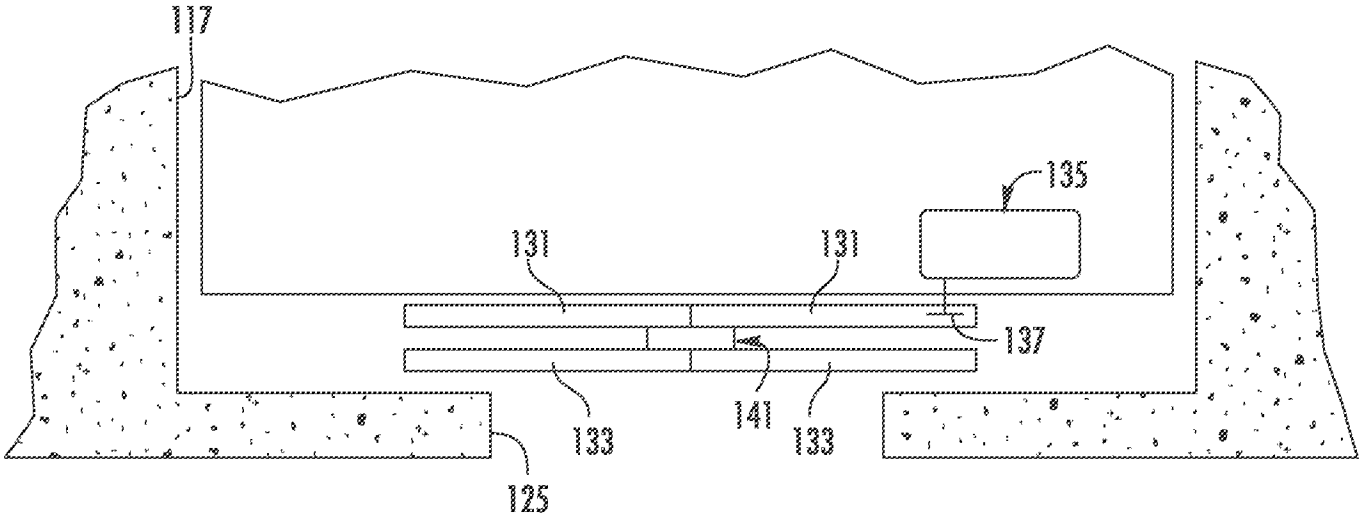
FIG. 2 is a plan view of an elevator car in an elevator hoistway while the elevator car doors and the landing doors are in a closed position and a car door interlock in locked position, according to an embodiment.
Figure 3:
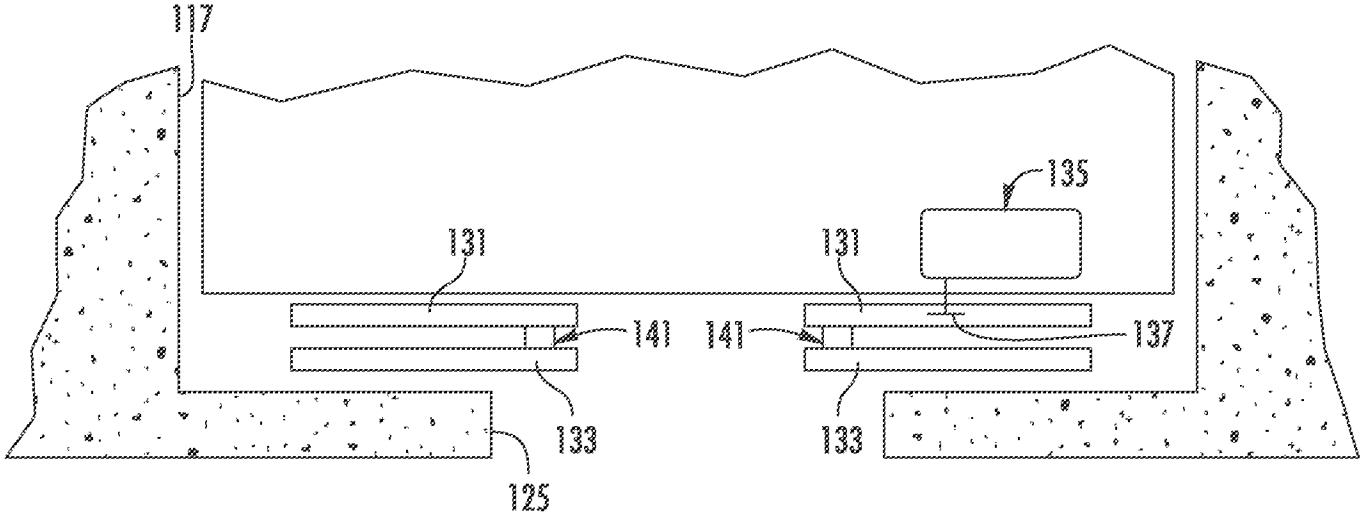
FIG. 3 is a plan view of an elevator Car in an elevator hoistway while the elevator car doors and the landing doors are in an open position and the car door interlock in an unlocked position, according to an embodiment.

Referring to FIGS. 2 and 3, the elevator car 103 of the elevator system 101 is shown in plan view within the elevator hoistway 117. The elevator car 103 includes a pair of movable elevator car doors 131 and correspondence with movable landing doors 133. The elevator car doors 131 and/or the movable landing doors 133 are moved between a closed position, as shown in FIG. 2, and an open position, as shown in FIG. 3, by a drive mechanism 135 having a belt drive 137. The elevator car doors 131 are inhibited from moving between the closed position and the open position when the elevator car 103 is between landings 125 by an elevator car door interlock 141 that is operatively connected to the elevator car doors 131. The elevator car doors 131 are enabled to move between the closed position and the open position by the elevator car door interlock 141 while the elevator car 103 is at a landing 125 or within a landing zone/unlocking zone.

Figure 4:
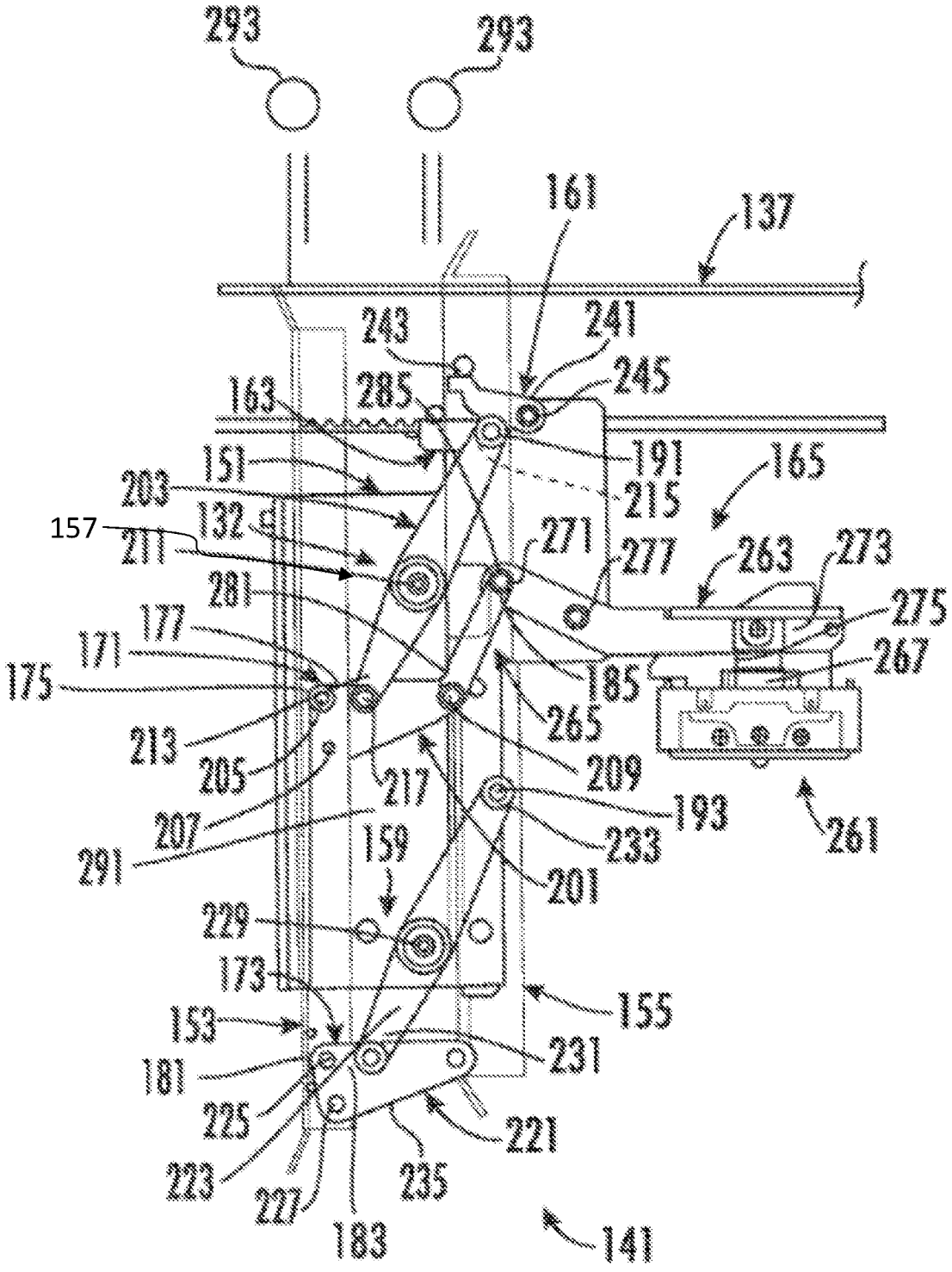
FIG. 4 is a perspective view of the car door interlock in the closed position, according to an embodiment.
Figure 5:
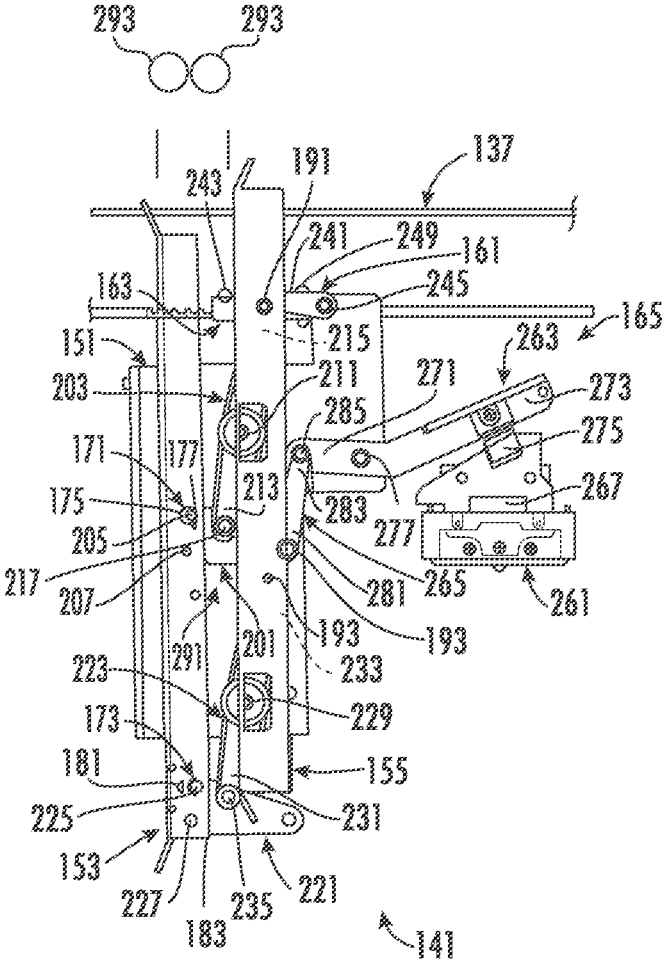
FIG. 5 is a perspective view of the car door interlock in the open position, according to an embodiment.
Figure 6:
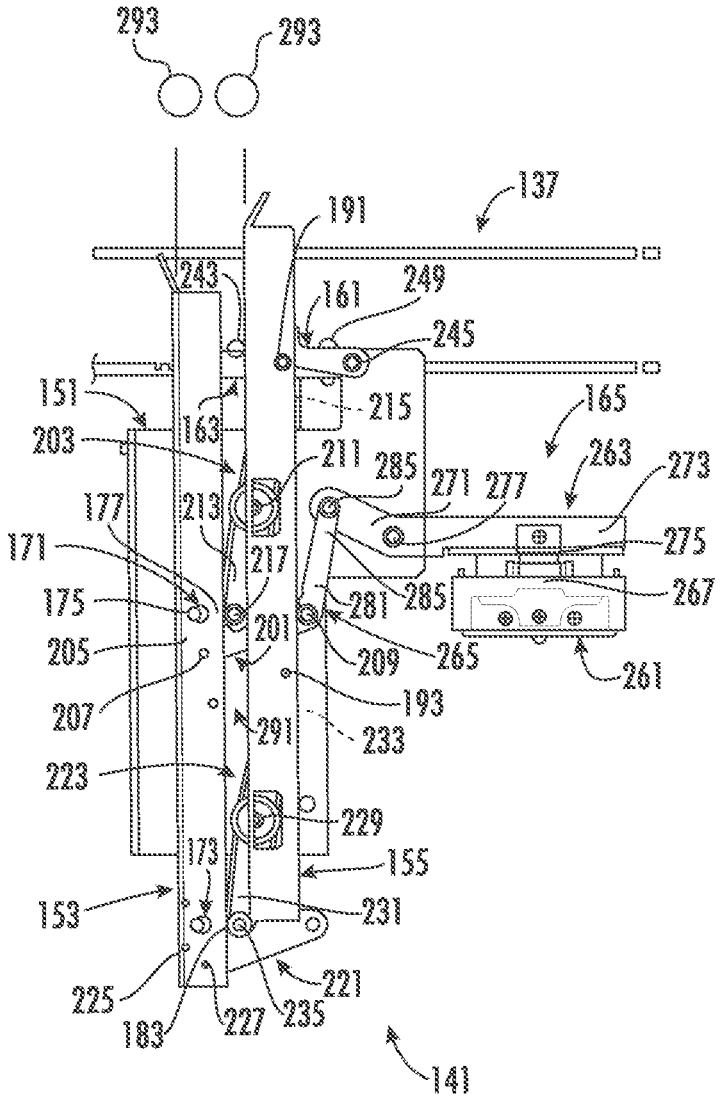
FIG. 6 is a perspective view of the car door interlock spaced apart from the interlock rollers and in a locked position to inhibit the elevator car doors from moving towards the open position, according to an embodiment.

Referring to FIGS. 4-6, the elevator car door interlock 141 is arranged as a compressing-type car door interlock that unlatches or unlocks the elevator car doors 131 when vanes of the elevator car door interlock 141 move towards each other while an interlock roller engages at least one vane while the elevator car is at or proximate the landing 125. The elevator car door interlock 141 includes a baseplate 151, a first vane 153, a second vane 155, a first link assembly 157, a second link assembly 159, a pawl assembly 161, a belt or pawl guide 163, and a latch assembly 165.

The baseplate 151 may be disposed on an elevator car door 131. The first vane 153 and the second vane 155 are movably disposed on the baseplate 151 relative to each other. The first vane 153 may be a sensing vane that extends along a vertical axis that is disposed parallel to the direction of travel of the elevator car 103. The first vane 153 defines a first slot 171 and a second slot 173 that is spaced apart from the first slot 171. The first slot 171 is a generally elongated slot that extends between a first slot first end 175 and a first slot second end 177 along a horizontal axis. The second slot 173 is axially spaced apart from the first slot 171 along the vertical axis. The second slot 173 is a generally elongated slot that extends between a second slot first end 181 and a second slot second end 183 along the horizontal axis.

The second vane 155 is spaced apart from the first vane 153. The second vane 155 may be a forward or leading vane that extends along a vertical axis that is disposed parallel to the direction of travel of the elevator car 103. The second vane 155 defines a pivot pin 191 and a second pivot 193 that is axially spaced apart from the pivot pin 191 along the vertical axis.

The operation of the drive mechanism 135 through the belt drive 137 in a first direction moves the first vane 153 towards the second vane 155, relative to the baseplate 151, pivoting at least one of the first link assembly 157 and the second link assembly 159, to move or actuate the latch assembly 165 that enables the elevator car doors 131 to move between the closed position and the open position, while the elevator car 103 is at the landing 125. The operation of the drive mechanism 135 through the belt drive 137 and a second direction that is disposed opposite the first direction, moves the first vane 153 away from the second vane 155, relative to the baseplate 151, pivoting at least one of the first link assembly 157 and the second link assembly 159, to move the elevator car doors 131 between the open position and the closed position and to move or actuate the latch assembly 165 to lock the elevator car doors 131.

The first link assembly 157 is movably connected to the first vane 153 and the second vane 155. The first link assembly 157 includes a first intermediate link 201.

The first intermediate link 201 includes a pivot pin 205, a second pivot 207, and a third pivot 209. The pivot pin 205 extends into the first slot 171 of the first vane 153. The second pivot 207 extends into the first vane 153. The pivot pin 205 is arranged to translate from the first slot first end 175 towards the first slot second end 177 responsive to the engagement between the first vane 153 and an interlock roller, while the first vane 153 is moved towards the second vane 155 by the belt drive 137. The translation of the pivot pin 205 within the first slot 171 enables the first intermediate link 201 to pivot about the second pivot 207 responsive to the engagement between the first vane 153 and an interlock roller, while the first vane 153 is moved towards the second vane 155 by the belt drive 137. The pivoting of the first intermediate link 201 about the second pivot 207 causes the third pivot 209 to pivot the latch assembly 165 to unlock elevator car door interlock 141.

A first link 203 is pivotally connected to the baseplate 151 through a pivot 211. The first link 203 extends between the first intermediate link 201 and the second vane 155. The first link 203 has a first link first end 213 that is pivotally connected to the first intermediate link 201 through a first pivot 217 and a first link second end 215 that is pivotally connected to the second vane 155 through the pivot pin 191. The first intermediate link 201 is disposed between the pivot pin 205 and the second pivot 207. The first link second end 215 is connected to the second vane 155 and is connected to the belt drive 137, through a belt hitch or belt or pawl guide 163, such that operation of the belt drive 137 drives or pivots the first link 203 of the first link assembly 157 about the pivot 211 and the second link assembly 159 to move the first vane 153 and the second vane 155 relative to each other to move between an open position and a closed position.

The second link assembly 159 is movably connected to the first vane 153 and the second vane 155. The second link assembly 159 includes a second intermediate link 221.

The second intermediate link 221 is movably connected to the first vane 153 and includes a pivot pin 225 and a fifth pivot 227. The pivot pin 225 extends into the second slot 173 of the first vane 153. The fifth pivot 227 extends into the first vane 153. The translation of the pivot pin 225 within the second slot 173 enables the second intermediate link 221 to pivot about the fifth pivot 227 responsive to the engagement between the first vane 153 and an interlock roller, while the first vane 153 is moved towards the second vane 155 by the belt drive 137. The pivoting of the second intermediate link 221 about the fifth pivot 227 causes the second link 223 to facilitate in the movement of the second vane 155 relative to the first vane 153.

A second link 223 is pivotally connected to the baseplate 151 through a pivot 229. The second link 223 extends between the second intermediate link 221 and the second vane 155. The second link 223 has a second link first end 231 that is pivotally connected to the second intermediate link 201 through a pivot 235 and a second link second end 233 that is pivotally connected to the second vane 155 through the second pivot 193.

The pawl assembly 161 includes a pawl 241 and a rod 243 that extends from the pawl 241. The pawl 241 includes a first pawl pivot 245 and a second pawl pivot. The first pawl pivot 245 is pivotally connected to the baseplate 151. The second pawl pivot may be the pivot pin 191 or share a common pivot point with the pivot pin 191 that is connected to the second vane 155, the first link second end 215, and the belt hitch 163.

The pawl 241 is arranged to rotate about the first pawl pivot 245 to lock and unlock the pivot pin 191. The pawl 241 is a latching member wherein responsive to operation of the drive mechanism in the first direction, the pawl 241 pivots about the first pawl pivot 245 towards a lock position or latched position to maintain a position or predetermined distance between the first vane 153 relative to the second vane 155, while the vanes are in the open position, as shown in FIG. 5. Responsive to operation of the drive mechanism 135 in the second direction, the pawl 241 pivots about the first pawl pivot 245 towards and unlock position or unlatched position to facilitate the movement of the first vane 153 away from the second vane 155 such that the vanes may move towards the closed position, as shown in FIG. 4. Movement of the pawl 241 towards the unlock position as the rod 243 rides along a ramp 249 of the belt or pawl guide 163 to unlock the pivot pin 191, unlocking the vanes and allowing the latch assembly 165 to latch or lock.

The latch assembly 165 includes a lock member 261, a door latch 263, and a latch link 265. The lock member 261 may be mounted to the car door header of the elevator car door 131 or other location such that the engagement between the door latch 263 and the lock member 261 inhibits the opening of the elevator car doors 131. The lock member 261 defines a slot or a protrusion that is arranged to interface with the door latch 263 to inhibit the elevator car doors 131 from moving from the closed position towards the open position. The lock member 261 includes a switch 267 that is in communication with the controller 115. The switch 267 provides a signal indicative of the elevator car doors 131 being in the closed position, while the door latch 263 engages the lock member 261. The switch 267 provides a signal indicative of the elevator car doors 131 being in the open or unlocked position, while the door latch 263 is disengaged from or spaced apart from the lock member 261.

The door latch 263 is pivotally connected to the baseplate 151. The door latch 263 has a door latch first end 271 and a door latch second end 273 that defines an engagement member 275 that selectively engages the switch 267 while the door latch 263 is in a closed or latched position to selectively inhibit opening of the elevator car door 131. The door latch 263 defines a latch pivot 277 that is disposed between the door latch first end 271 and the door latch second end 273 that pivotally connects the door latch 263 to the baseplate 151. The door latch first end 271 is disposed in a nonparallel and non-perpendicular relationship with respect to the door latch second end 273 to facilitate a rocking motion of the door latch 263 about the latch pivot 277.

The latch link 265 extends between the door latch 263 and the first intermediate link 201. The latch link 265 has a latch link first end 281 that is pivotally connected to the first intermediate link 201 through the third pivot 209 and a latch link second end 283 that is pivotally connected to the door latch first and 271 through a pivot 285. The door latch 263 is arranged to selectively engage the lock member 261 responsive to the latch link 265 pivoting with the first intermediate link 201.

While the door latch 263 is in a latched position with the lock member 261 and an interlock roller 293 is spaced apart from at least one of the first vane 153 and the second vane 155, responsive to operation of the drive mechanism 135 that is drivably connected to the first link second end 215 and the pawl assembly 161 through the belt drive 137 (indicating that the elevator car 103 is not within an unlock zone of the landing 125 and the elevator car doors 131 are being forcibly moved from the closed position towards the open position), the first vane 153 moves relative to the second vane 155 and the pivot pin 205 is disposed proximate the first slot first end 175. Due to the interlock roller 293 being spaced apart from at least one of the first vane 153 and the second vane 155 and the pivot pin 205 being disposed proximate the first slot first end 175, the first intermediate link 201 is inhibited from pivoting about the second pivot 207 such that the door latch 263 is inhibited from being pivoted about the latch pivot 277, inhibiting the opening of the elevator car doors 131, as shown in FIG. 4.

While the door latch 263 is in a latched position with the lock member 261 and an interlock roller 293 engages at least one of the first vane 153 and the second vane 155, responsive to operation of the drive mechanism 135 that is drivably connected to the first link second end 215 and the pawl assembly 161 through the belt drive 137 (e.g. the elevator car 103 being within an unlock zone of the landing 125 and the elevator car doors 131 being driven from the closed position towards the open position by the belt drive 137), the first vane 153 moves relative to the second vane 155 such that the vanes compress, at least one of the pivot pin 205 moves from the first slot first end 175 towards the first slot second end 177 and/or the pivot pin 225 moves from the second slot first end 181 towards the second slot second end 183, and the first intermediate link 201 pivots about the second pivot 207 such that the latch link 265 pivots the door latch 263 about the latch pivot 277 to disengage the engagement member 275 at the door latch second end 273 from the lock member 261, facilitating the opening of the elevator car doors 131, as shown in FIG. 5.

A spring or a biasing member 291 is arranged to close or move the second vane 155 relative to the first vane 153 when power is lost to the elevator car 103. The biasing member 291 is connected to the first vane 153 in at least one of the second vane 155 and/or the second link second end 233. The biasing member 291 and is arranged to move the second vane 155 such that the second intermediate link 221 pivots about the fifth pivot 227 and the first intermediate link 201 pivots about the second pivot 207 such that the latch link 265 pivots the door latch 263 about the latch pivot 277 to disengage the engagement member 275 from the switch 267 of the lock member 261 in the event that power is lost to the drive mechanism 135 and/or the belt drive 137 and the elevator is positioned within an unlock zone in which an interlock roller 293 engages at least one of the first vane 153 and the second vane 155, as shown in FIG. 6.

The elevator car door interlock 141 is arranged as an evacuation deterrent device that inhibits the opening and closing of the elevator car doors 131 while the interlock roller 293 is spaced apart from the vanes indicating that the elevator car 103 is not within an unlock zone associated with the landing 125.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator car door interlock, comprising:

a first vane;

a second vane;

a first link assembly, comprising:

a first intermediate link movably connected to the first vane, and a first link pivotally connected to a baseplate, the first link having a first link first end pivotally connected to the first intermediate link and a first link second end pivotally connected to the second vane; and a latch assembly, comprising:

a door latch pivotally connected to the baseplate, the door latch having a door latch first end and a door latch second end, and a latch link having a latch link first end pivotally connected to the first intermediate link and a latch link second end pivotally connected to the door latch first end;

wherein the first vane defines a closed slot having a first slot first end and first slot second end;

wherein the first intermediate link includes a pivot pin that extends into the closed slot and a second pivot that extends into the first vane;

wherein responsive to operation of a drive mechanism that is drivably connected to the first link second end, while an interlock roller engages at least one of the first vane and the second vane, the first vane moves, relative to the baseplate, towards the second vane and the pivot pin moves from the first slot first end towards the first slot second end.

2. The elevator car door interlock of claim 1, wherein responsive to operation of a drive mechanism that is drivably connected to the first link second end, while an interlock roller is spaced apart from at least one of the first vane and the second vane, the first vane moves, relative to the baseplate, towards the second vane and the pivot pin is disposed proximate the first slot first end.

3. The elevator car door interlock of claim 2, wherein while the pivot pin is disposed proximate the first slot first end, the first intermediate link is inhibited from pivoting about the second pivot and the door latch is inhibited from being pivoted.

4. The elevator car door interlock of claim 1, wherein responsive to the pivot pin moving from the first slot first end towards the first slot second end, the first intermediate link pivots about the second pivot such that the latch link pivots the door latch.

5. An elevator car door interlock, comprising:

a first link assembly, comprising:

a first intermediate link movably connected to a first vane, and a first link pivotally connected to a baseplate, the first link having a first link first end pivotally connected to the first intermediate link and a first link second end pivotally connected to a second vane;

a latch assembly, comprising:

a door latch pivotally connected to the baseplate, the door latch having a door latch first end and a door latch second end that is arranged to selectively engage a lock member to selectively inhibit opening of an elevator car door, and a latch link having a latch link first end pivotally connected to the first intermediate link and a latch link second end pivotally connected to the door latch first end; and wherein the first vane defines a closed first slot having a first slot first end and first slot second end;

wherein the first intermediate link includes a pivot pin that extends into the first slot having a first slot first end and first slot second end, a second pivot that extends into the first vane, and a third pivot that extends into the latch link first end;

wherein responsive to operation of a drive mechanism that is drivably connected to the first link second end, the first vane moves, relative to the baseplate, towards the second vane and the pivot pin moves from the first slot first end towards the first slot second end.

6. The elevator car door interlock of claim 5, further comprising:

a second link assembly spaced apart from the first link assembly, the second link assembly, comprising:

a second intermediate link movably connected to the first vane, and a second link pivotally connected to the baseplate, the second link having a second link first end pivotally connected to the second intermediate link and a second link second end pivotally connected to the second vane.

7. The elevator car door interlock of claim 6, wherein the first vane defines a second slot having a second slot first end and second slot second end.

8. The elevator car door interlock of claim 7, wherein the second intermediate link includes a second pivot pin that extends into the second slot and a fifth pivot that extends into the first vane.

9. The elevator car door interlock of claim 8, wherein responsive to operation of the drive mechanism that is drivably connected to the first link second end and the pawl in a first direction, while an interlock roller engages at least one of the first vane and the second vane, the first vane moves, relative to the baseplate, towards the second vane, at least one of the pivot pin moves from the first slot first end towards the first slot second end and the second pivot pin moves from the second slot first end towards the second slot second end, such that the first intermediate link pivots about the second pivot such that the latch link pivots the door latch to disengage the lock member.

10. The elevator car door interlock of claim 9, further comprising:

a biasing member connected to the first vane and at least one of the second vane and a second link second end.

11. The elevator car door interlock of claim 10, wherein the biasing member is arranged to move the second vane such that the second intermediate link pivots about the fifth pivot and the first intermediate link pivots about the second pivot such that the latch link pivots the door latch to disengage the lock member.

* * * * *